United States Patent [19]

Van Horn

[11] 3,944,222

[45] Mar. 16, 1976

[54] GAME

[76] Inventor: George E. Van Horn, P.O. Box 65, Ehrenberg, Ariz. 85334

[22] Filed: June 6, 1974

[21] Appl. No.: 477,550

[52] U.S. Cl. ..... 273/1 M; 46/236

[51] Int. Cl.[2] ..... A63F 9/14

[58] Field of Search ..... 273/1 M, 86 B; 46/236, 46/238

[56] References Cited

UNITED STATES PATENTS

| | | | |
|---|---|---|---|
| 2,249,454 | 7/1941 | Brake | 46/240 |
| 2,463,795 | 3/1949 | Neuzerling | 273/86 B |
| 2,528,938 | 11/1950 | Wolf | 273/94 |
| 3,214,171 | 10/1965 | Luchsinger | 273/1 M X |
| 3,433,478 | 3/1969 | Span et al. | 273/1 M |

FOREIGN PATENTS OR APPLICATIONS

| | | | |
|---|---|---|---|
| 1,282,155 | 12/1961 | France | 273/1 M |

*Primary Examiner*—Paul E. Shapiro

[57] ABSTRACT

A game comprising a playing surface having an upward fence-like projection having an opening therethrough and game pieces containing magnets so that a player manipulating one game piece may attempt to propel by magnetic force another game piece through said opening. The magnetic poles in the game pieces are in a plane parallel to the playing surface. The upward fence-like projection may divide the playing surface into a plurality of starting spaces and a finishing space with an opening from each starting space to the finishing space. The finishing space may be in the center of the playing surface surrounded by the starting spaces.

1 Claim, 1 Drawing Figure

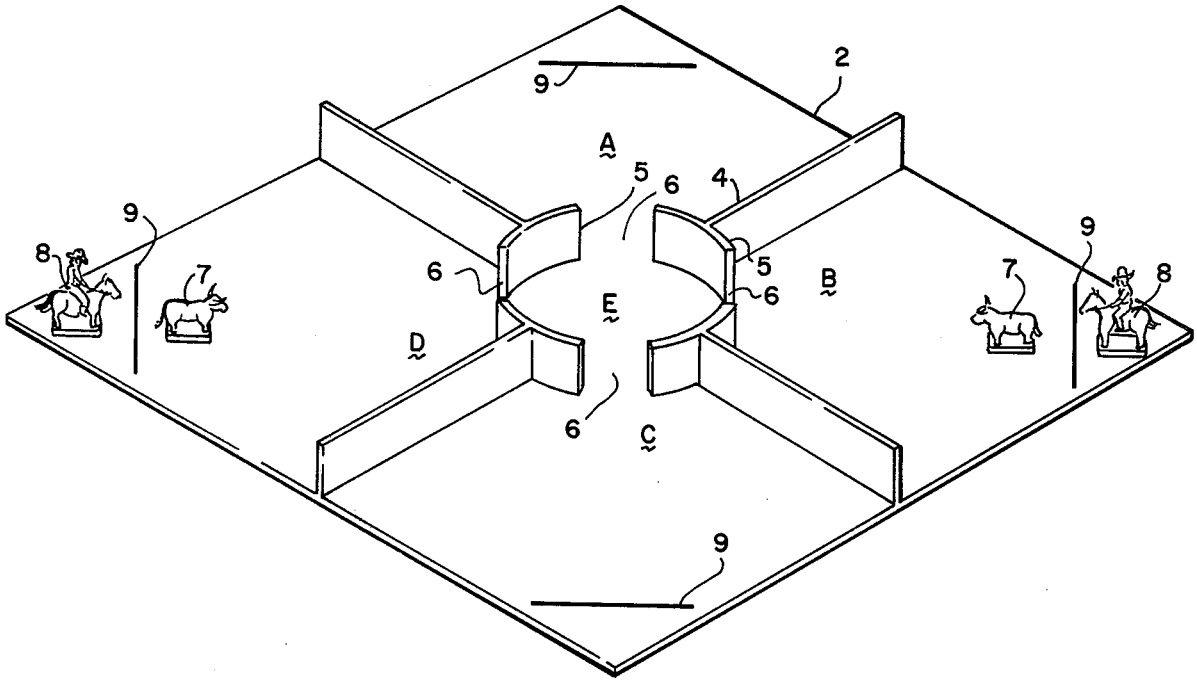
2
9
A
5
6
4
9
8
7
6
E
5
6
B
7
9
8
D
6
C
9

GAME

This invention relates to a game and more particularly to a game comprising a playing surface with game pieces containing magnets so that players each manipulating one game piece may attempt to propel by magnetic force other game pieces through an obstacle course on the playing surface. The game pieces are of non-magnetic material and may be formed to simulate persons or animals with the magnets oriented in the game pieces so that the magnetic poles are in a plane parallel to the playing surface when the game pieces are disposed in upright or natural position. For example, some of the game pieces may simulate steers with the magnets oriented therein so that the poles are respectively at the head and hind quarters of the steer when in upright position; and other of the game pieces may simulate cowboys on horseback with the magnets oriented therein so that the poles are respectively at the head and hind quarters of the horse. The poles in the steers' magnets are reversed relatively to the poles in the magnets of the cowboys on horseback; for example, the positive poles may be at the steers' hind quarters and at the horses' heads. The steers stand freely on the playing surface. The players each hold a cowboy on horseback and manipulate it on the playing surface so as to approach one of the steers and attempt by magnetic force alone to prod the steer to move in a prescribed direction. As the horse's head approaches the steer's hind quarters the like poles (e.g., the positive pole at the horse's head and the positive pole at the steer's hind quarters) repel each other, and since the horse is being manipulated by the player while the steer stands freely on the playing surface the steer is moved forward by magnetic force.

The playing surface has an upward fence-like projection having an opening therethrough through which a player may attempt to propel a game piece by magnetic force as above described. The upward fence-like projection may divide the playing surface into a plurality of starting spaces which may simulate fenced pastures and a finishing space which may simulate a pen with an opening from each starting space or pasture to the finishing space or pen. The pen may be in the center of the playing surface surrounded by the pastures. There may be as many players as there are pastures. Each player attempts to propel a steer by magnetic force as above described from his pasture into the pen through the opening from the pasture to the pen. The player who thus propels his steer into the pen first is the winner. I call this the "Cowboy Cutting Horse Game".

Other details, objects and advantages of the invention will become apparent as the following description of a present preferred embodiment thereof proceeds.

The accompanying drawing is a diagrammatic illustration of one form of my game.

Referring now more particularly to the drawing, reference numeral 2 designates generally a playing surface which may be in the form of a flat board having disposed thereupon upward fence-like projections 4 and 5. These upward fence-like projections divide the board into five spaces designated A, B, C, D and E. The spaces A, B, C and D are starting spaces and may simulate fenced pastures. The space E is the finishing space and may simulate a pen. There is an opening 6 from each pasture into the pen.

The game pieces are, as above described, of non-magnetic material and in the form shown are formed to simulate steers and cowboys on horseback. The steers are designated 7 and the cowboys on horseback are designated 8. As above described the magnets are arranged in the game pieces so that the poles in the steers' magnets are reversed relatively to the poles in the magnets in the cowboys on horseback. Thus when the steers stand freely on the playing surface in the respective pastures and the players manipulate the cowboys on horseback the steers may be propelled or prodded by magnetic force to move through the openings 6 into the pen E. Reference numeral 9 designates the starting lines in the various pastures.

While I have shown and described a present preferred embodiment of the invention it is to be distinctly understood that the invention is not limited thereto but may be otherwise variously embodied within the scope of the following claims.

I claim:

1. A game comprising a playing surface having an upward fence-like projection dividing the playing surface into a plurality of starting spaces and a finishing space with an opening from each starting space to the finishing space, each starting space being bounded laterally by radial elements of the upward fence-like projection and the opening from each starting space to the finishing space being of less width than the distance between the inner ends of the radial elements of the upward fence-like projection bounding laterally the starting space, and game pieces containing magnets all disposed above the playing surface so that a player manipulating one game piece may attempt to propel by magnetic force another game piece through one of said openings.

* * * * *